United States Patent [19]

Boriskie et al.

[11] Patent Number: 4,731,912

[45] Date of Patent: Mar. 22, 1988

[54] SEAT BELT BUCKLE GUARD

[75] Inventors: Helen A. Boriskie, Dallas, Tex.; Louis Emmer, Oklahoma City, Okla.

[73] Assignee: Ashlar Products, Incorporated, Dallas, Tex.

[21] Appl. No.: 909,253

[22] Filed: Sep. 19, 1986

[51] Int. Cl.[4] ..... A41F 1/00

[52] U.S. Cl. ..... 24/633; 24/574; 24/487

[58] Field of Search ..... 24/633, 487, 543, 545, 24/570, 573, 574, 589, 636, 637; 220/337, 339; 206/485

[56] References Cited

U.S. PATENT DOCUMENTS

| | | | |
|---|---|---|---|
| 1,494,680 | 5/1924 | Fisk | 24/574 |
| 3,221,919 | 12/1965 | Gessner | 220/337 |
| 3,484,908 | 12/1969 | Lamb | 24/574 |
| 3,824,654 | 7/1974 | Takabayashi | 24/487 X |
| 4,014,080 | 3/1977 | Caradec | 24/230 R |
| 4,033,156 | 7/1977 | Cottingham | 70/56 |
| 4,062,091 | 12/1977 | Holmberg | 24/637 |
| 4,068,505 | 11/1978 | Volk, Jr. | 70/56 |
| 4,356,599 | 11/1982 | Larson et al. | 24/487 X |
| 4,497,094 | 2/1985 | Morris | 24/633 |
| 4,502,194 | 3/1985 | Morris et al. | 24/633 |
| 4,535,514 | 8/1985 | Grabowski | 24/637 X |
| 4,581,481 | 4/1986 | Moretti | 24/487 X |
| 4,624,033 | 11/1986 | Orton | 24/633 |

FOREIGN PATENT DOCUMENTS

| | | | |
|---|---|---|---|
| 247962 | 11/1963 | Australia | 24/574 |
| WO84/01275 | 4/1984 | World Int. Prop. O. | 24/633 |
| 184694 | 8/1922 | United Kingdom | 220/337 |

*Primary Examiner*—Kenneth J. Dorner
*Assistant Examiner*—Laurie K. Cranmer
*Attorney, Agent, or Firm*—Hubbard, Thurman, Turner & Tucker

[57] ABSTRACT

A seat belt buckle release guard apparatus has a box like device including first and second portions having recessed opposing ends and sides that are shelf hinged on one side, and bear a latch on a side opposing the hinged side. When the first and second portions are closed, opposing end apertures are formed for receiving a seat belt buckle segment and a tongue segment with the buckle sandwiched between the first and second portions. In one embodiment the latch bearing first portion side is recessed and a latching lug is formed within the recess; the latch bearing second portion side includes a latch for engaging the lug to close the box like device. When closed the recess forms a guide to the latch. The bottom of the recess is thickened to stiffen the latch bearing side and to position the seat belt buckle in the box like device. In operation the recess thickened bottom coacts with the box like device sides and seat belt buckle to rigidify the box and enhance the latching strength of the latch thereby making it difficult for a child to open the box like device and push the seat belt release button.

9 Claims, 7 Drawing Figures

SEAT BELT BUCKLE GUARD

BACKGROUND OF THE INVENTION

This invention relates to seat belts and more particularly to a seat belt buckle release guard apparatus for deterring small children of an age to be fastened in a vehicle in the usual manner from unfastening the belt.

The purpose of seat belt buckle release guards is to deter children, primarily aged 12 months of four years or about forty pounds in weight from releasing the standard adult seat belt buckles by pushing or popping the release button on the belt while riding in the vehicle. The need is for safety. As a child generally is trapped into the back of the car, either in a car chair or in the back seat using the belt provided with the car depending on age or size, should the seat belt be open when the car is suddenly braked or involved in an accident, the child's safety is jeopardized.

In the past, a seat belt release guard apparatus has included a sleeve for enclosing snugly a seat belt latching housing attached to one segment of the seat belt. The latching housing includes a release button conveniently located, generally on the front, for releasing a latch tongue fixed to a second segment of the seat belt. The sleeve has one end partially closed to provide an aperture through which the latch tongue is passed for latching. The sleeve also has an aperture corresponding in location to the latching housing release button. When positioned over the latching housing, the sleeve is retained in place by the engaged latch tongue. Those persons skilled in the art desiring more information concerning the prior art device are referred to U.S. Pat. No. 4,502,194 issued Mar. 5, 1985 to Morris et al., or U.S. Pat. No. 4,497,094 issued Feb. 5, 1985 to Morris.

A problem with the above mentioned prior art device is that it requires the use of an object capable of being passed through the sleeve release button aperture to engage the release button for latch tongue release. This feature is troublesome enough during normal seat belt usage and becomes even more so during emergency use such as when the vehicle is involved in an accident or on fire. Further, if the above-mentioned prior art device gets flipped over and buckled, it becomes most difficult to gain access to the hole for unfastening.

Although the seat belt buckle guard according to this invention also has for its purpose the protection of the seat belt release button, it differs from the above described device in that the guard is simple in design to make it easy to apply as a cover for the existing vehicle seat belt buckle in use; its closure means is located to be out of sight or reach of the curious fingers of small children and is designed for quick release by an adult. Further, the guard may be either removed when not in use for children, or it may be left in place for use next time without restricting or eliminating the normal function of the seat belt buckle.

SUMMARY OF THE INVENTION

Accordingly, it is an object of the present invention to provide an improved seat belt buckle guard.

Another object of the invention is to provide a seat buckle guard which is easy to operate by an adult for quick release during emergencies as well as during normal usage, while providing substantial protection against small child release.

A further object of the invention is to provide a seat belt buckle guard which is mass producible, inexpensive, and reliable.

Still another object of the invention is to provide a seat belt buckle guard design which lends itself to the manufacturing of a size and shape to fit the various style seat belt buckles available.

Yet another object of the invention is to provide a seat belt guard adapted to enclose a seat belt buckle and thereafter provide seat belt tongue access for seat belt buckling.

Briefly stated the invention includes a plastic box like device having first and second portions for sandwiching a seat belt latching mechanism having a release button for disengaging the seat belt segments. A latching means operatively connects the first and second box portions about the seat belt latching mechanism in a small child opening resistant location and manner. Thus, the seat belt button release is protected from child manipulation, while the latching means is readily operable by an adult for unlocking the box for access to the seat belt release.

BRIEF DESCRIPTION OF THE DRAWINGS

Other objects and features of the invention will become more readily understood from the following detailed description and appended claims when read in conjunction with the accompanying drawings in which:

DETAILED DESCRIPTION OF THE PREFERRED EMBODIMENTS

Figure 1:
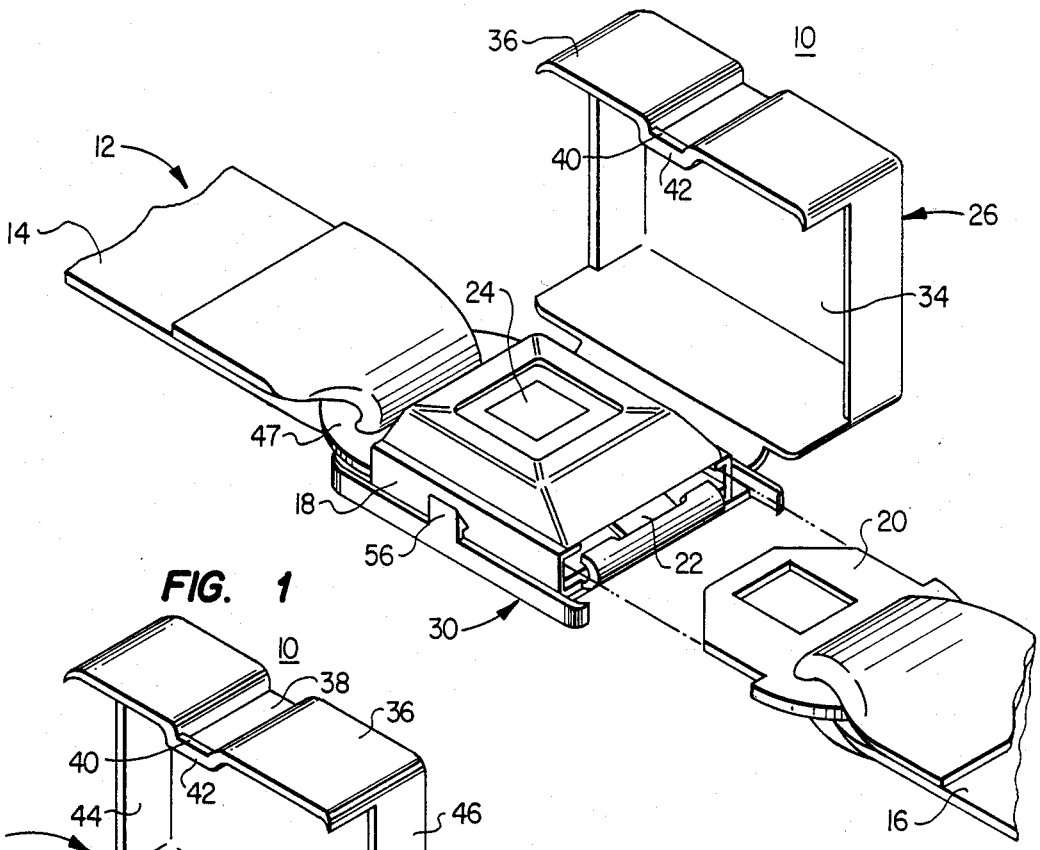
FIG. 1 is an isometric view of a first embodiment of the seat belt buckle guard in an opened position to disclose the seat belt latch housing positioned to receive the tongue segment.

Referring now to FIG. 1, in which is shown a first embodiment of the seat belt buckle guard 10 together with a first standard type seat belt 12 utilized, for example, in vehicles manufactured by General Motors Corporation or Ford Motor Company. The seat belt includes first and second belt segments 14 and 16. A latching housing or buckle 18 and an apertured tongue 20 are connected, respectively, to the first and second seat belt segments 14 and 16. The latching housing 18 has an apertured end 22 through which the apertured tongue is inserted to engage a spring type dog (not shown). A release button 24 is mounted in an aperture formed in the top (front) of the latching housing in engagement with the spring type dog. Thus, the release button 24 is conveniently located for use in disengaging the apertured tongue.

The seat belt buckle guard 10 (FIG. 2), which is designed as simple as possible for adult usage under any conditions, but which makes it difficult for a small child to push to disengage the seat belt sections, includes a box like structure 26, fabricated out of a tough, durable, thermosetting plastics material. The box like structure 26 has first and second portions 28 and 30 having sides preferably joined by a self hinge 32 to form a cover 28 and a bottom 30. The self hinge is outwardly curved (convex) to provide flexible connections to the sides to increase substantially the mean time before failure of the hinge.

The cover 28 has a top 34 and a side 36 opposite the hinged side which includes an inwardly recessed portion 38 having an outwardly extending lug 40 formed adjacent to the cover open bottom forming edge. A brace member 42 is formed integral with the recessed area for stiffening the lug bearing side of the cover. While, the opposing sides 44 and 46 of the top 34 are recessed to receive the seat belt latching housing section connecting ear 47 (FIG. 1) and the apertured tongue 20 of the second seat belt segment 16.

Figure 2:
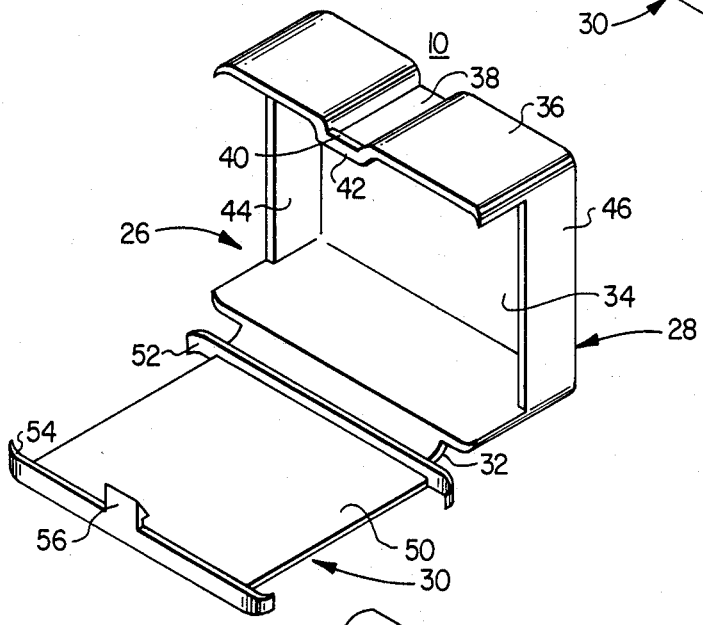
FIG. 2 is an isometric view of the seat belt buckle guard of FIG. 1 with the seat belt removed.

The bottom 30 (FIG. 2) includes a bottom 50 having opposing, upwardly and outwardly extending sides 52 and 54 having inwardly extending flanges at their ends for forming with the sides a retainer for the latch housing 18 (FIG. 1). The flanged sides 52 and 54 correspond to the ends of the covers sides depending from top 34 (FIG. 2). Side 52 is integrally connected to the hinge 32, while side 54 has an upwardly extending latch 56 positioned to engage the lug 40 of the cover. The latch and lug form a snap type latching mechanism.

Figure 3:
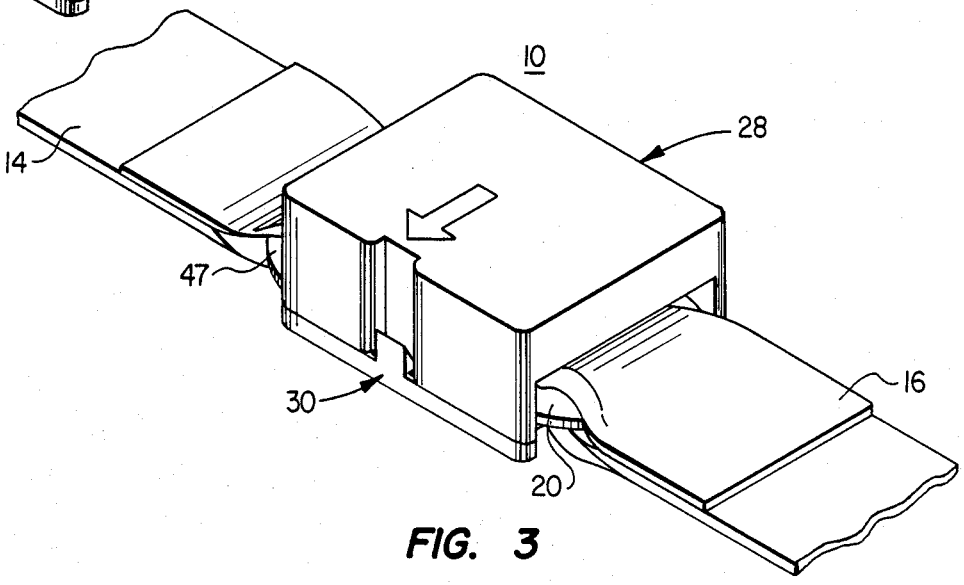
FIG. 3 is an isometric view of the seat belt buckle guard of FIG. 1 in the closed position with the latch housing opening ready to receive the seat belt tongue segment.

For safety reasons, the hinged side of the cover 26, which in operation of the device will be the top side, is provided with operating instructions (FIG. 3). The instructions may be, for example, "OPEN: PULL OR LIFT SNAP CLOSURE AT BOTTOM—OPPOSITE THIS NOTICE. PRESS RELEASE BUTTON ON SEAT BELT BUCKLE."
"CLOSE: PRESS DOWN ON COVER."

In operation the latch housing (buckle) 18 (FIG. 1) attached to seat belt segment 14 is inserted into the bottom 30 of the seat belt buckle guard and the cover 26 snapped shut by pressing downwardly on the cover to engage the latch lug 40 with the latch 56. In this position the cover brace member 42 coacts with the cover hinged side to sandwich the buckle 18 whereby these elements coact to remove any flexure from the lug bearing side 36 and provide a rigid structure firmly supporting the buckle 18. Then the apertured tongue, fixed to the second seat belt segment, is inserted through the open side of the cover to engage the seat belt buckle latch in the usual manner (FIG. 3) for buckling up. The release button is thus shielded by the front side 34. To disengage the tongue the latch which is now located in the bottom recess is pulled or lifted to disengage the lug. It will be appreciated by those persons skilled in the art that the recess provides a guide to the latch.

Figure 4:
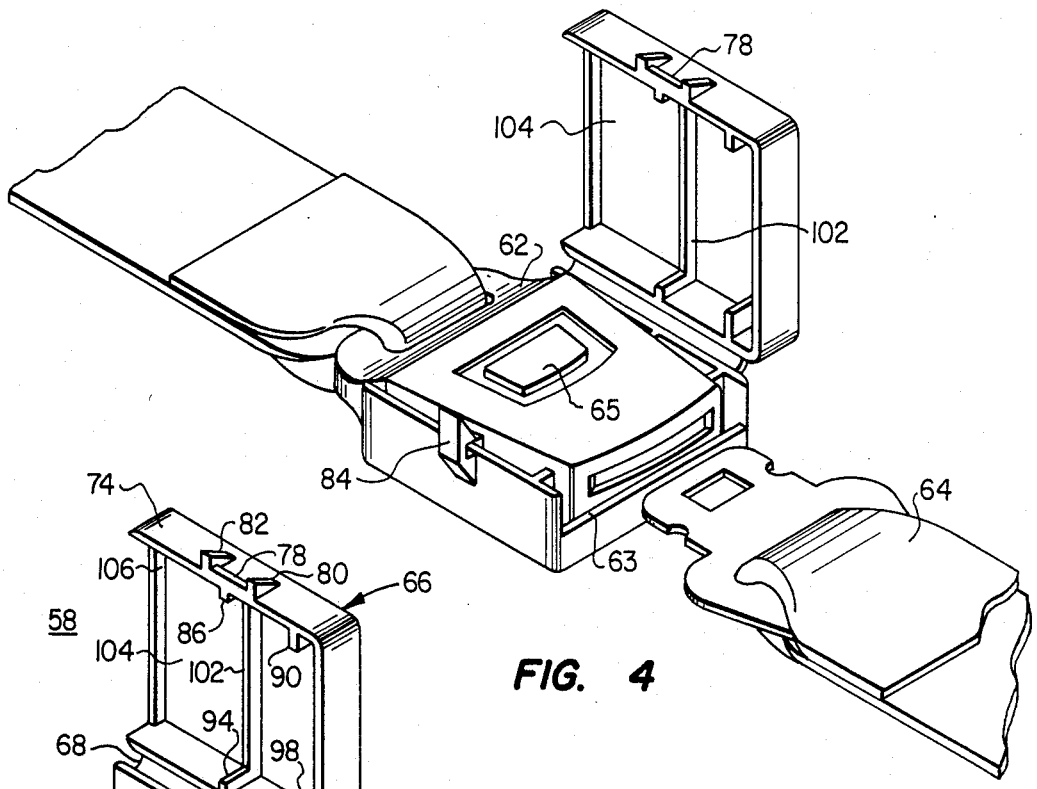
FIG. 4 is an isometric view of a second embodiment of the seat belt buckle guard with the seat belt buckle guard open to show the seat belt in position.

Referring now to FIG. 4, the seat belt buckle guard 58, in a second embodiment, is designed for use with a second standard type seat belt buckle such as, for example, that used on vehicles manufactured by Chrysler Corporation. The seat belt buckle 60 has a thicker latch housing having its seat belt segment attachment ear 62 formed integrally on the side of the housing. The ear is substantially coextensive with the size of the housing side. From the ear side opposing sides curve or taper inwardly to the tongue receiving side 63 where an apertured tongue attached to a second seat belt segment 64 may be inserted for attachment by a sprng biased dog. A latch release button 65 is mounted in an aperture formed in the front of the buckle 60.

Figure 5:
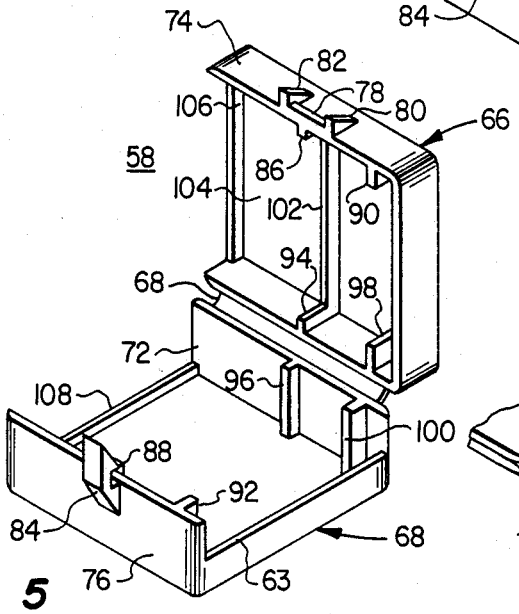
FIG. 5 is an isometric view of the seat belt buckle guard of FIG. 4 with the seat belt removed.

The seat belt buckle guard 58 (FIG. 5) includes first and second rectangularly shaped portions 66 and 68 having a self joining hinge connecting sides 70 and 72. Sides 70 and 72 form the top of the seat belt buckle guard, while opposing sides 74 and 76 form the bottom. An outwardly extending lug 78 is formed between spaced guide members 80 and 82 on side 74 adjacent an edge corresponding to edge of side 76. Preferably, the lug 78 and guide members 80 and 82 are formed integrally with side 74. A latch 84 is formed integrally with side 76 adjacent an edge corresponding with the lug bearing side edge when closed. The latch 84 has a width substantially equal to the spacing of guides 80 and 82, and is formed to engage the lug 78 to latch the first and second buckle guard portions 66 and 68 together. Ribs 86 and 88, and 90 and 92 are integrally formed, respectively, on sides 74 and 76 for stiffening purposes.

Ribs 86 and 88 are formed on the sides 74 and 76 directly behind, respectively, the lug 78 and the latch 84; while ribs 90 and 92 are formed, respectively, to correspond with each other between ribs 86 and 88 and the tongue receiving side 63. While, ribs 94 and 96, and ribs 98 and 100 are integrally formed, respectively, on hinged sides 70 and 72 directly opposite ribs 86 and 88, and ribs 90 and 92. A rib 102 is formed integrally with ribs 86 and 94, and back surface 104. The ribs 86 and 88, 94 and 96, 90 and 92, and 98 and 100 correspond in location and are contoured to provide buckle supports which coact with the buckle to provide a rigid buckle guard structure. The ribs also align the tapered buckle with the tongue receiving aperture.

Figure 7:
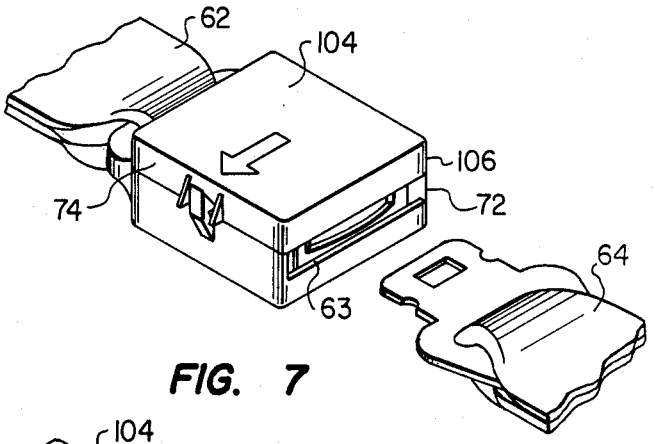
FIG. 7 is an isometric view of the seat belt guard in operative position with the seat belt open.
Figure 6:
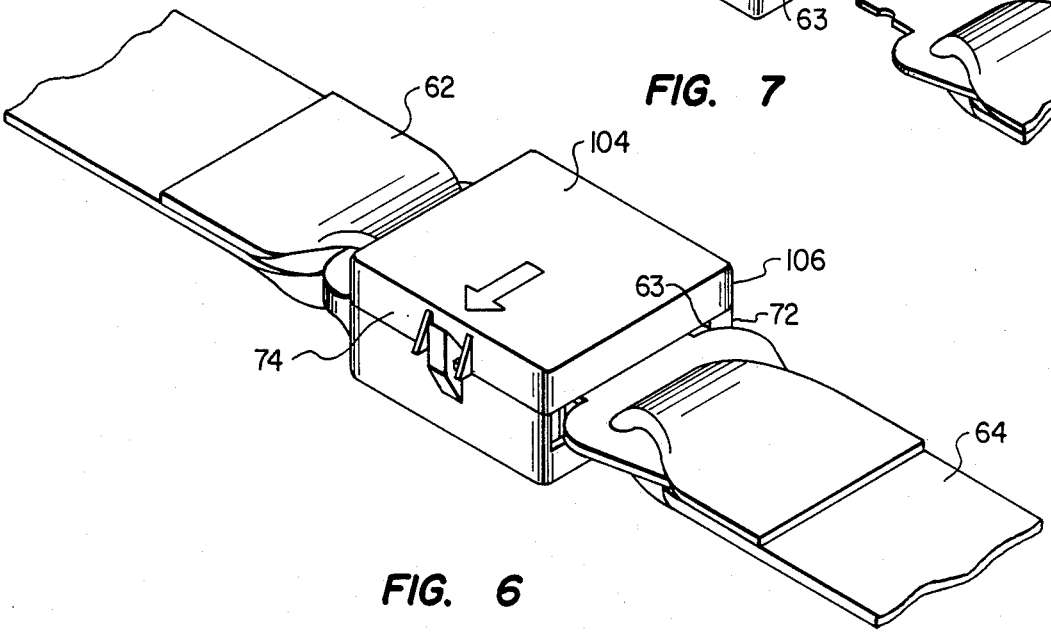
FIG. 6 is an isometric view of the seat belt guard of FIG. 4 in its operative position with respect to the seat belt.

The sides 106 and 108 are correspondingly recessed for forming a buckle ear receiving aperture for the first seat belt segment, while only side 63 is recessed for forming a tongue receiving aperture for the second seat belt segment. Thus, when the buckle is inserted in the open seat belt buckle guard 58 as shown in FIG. 4 and the buckle guard closed as shown in FIGS. 6 and 7, the apertured tongue (FIG. 7) can be inserted into the buckle latching aperture for fastening the seat belt segments together (FIG. 6). As the operation of the first and second embodiments are identical, the safety legend description and operation are not repeated.

Although several embodiments of the invention have been described, it will be apparent to those skilled in the art that various modifications to the details of construction shown and described may be made without departing from the scope of this invention.

What is claimed is:

1. A seat belt buckle guard for a seat belt buckle having an exposed release mechanism comprising:

in combination, a box like device having first and second housing portions;

the first and second housing portions each having a flat plate member and first and second pairs of opposing sides normal to the flat plate member, the flat plate members of the first and second housing portions forming front and back sides for the box like device, the first pair of opposing sides of the first and second housing portions having walls forming first and second opposing apertures therein, the second pair of opposing sides of the first and second housing portions each having corresponding first and second sides, a strengthening means connected to at least one of said second sides for strengthening a portion thereof for a latching means:

a hinge means between the first sides for pivotally connecting the corresponding first sides of the second pair of opposing sides, said corresponding first sides and hinge forming a top for the box like device; and a latching means operatively connected to the strengthened portion of the at least one of the said second sides for latching together the first and second housing portions to form a bottom for the box like device with the latching means thereon, whereby when a buckle of a segmented seat belt having the buckle and buckle tongue attached to the ends is placed in the first and second housing portions with the buckle end of the seat belt passing through the first aperture and the first and second housing portions closed and latched together the buckle including its release button is sandwiched in the box like device, positioned to engage the tongue end of the segmented seat belt when inserted through the second aperture, and coacts with the strengthening means to rigidify the box like device, and the latching means being attached to the bottom of the box like device is rendered difficult for child opening, and a seat belt buckle release mechanism is shielded from access.

2. A seat belt buckle guard according to claim 1 wherein the first and second housing portions of the box like device are of a plastic material and the hinge means is a plastic, convex shaped hinge formed integrally with the first and second housing portions.

3. A seat belt buckle guard according to claim 1 wherein the strengthening means for strengthening a portion of at least one of the second sides of the second pair of opposing sides of the first portion of the box like device includes a centrally disposed recess forming a brace for the first portion, whereby when the seat buckle is latched in the first and second housing portions, the buckle and recess coact with the first and second housing portions to enhance substantially a snap action of the latching means.

4. A seat buckle guard according to claim 1 wherein the first housing portion of the box like device has a depth substantially greater than the depth of the second housing portion and the strengthening means includes a centrally disposed recess and the latching means includes a latching lug formed in the recess and a latch formed on a corresponding side of the second housing portion, said latch adapted for engaging the latching lug for securing together the first and second housing portions whereby the latch means being on the bottom adjacent to the corresponding side of the second housing portion of the box like device the recess forms a guide to the latch during opening and closing.

5. A seat belt buckle guard according to claim 1 wherein the second side of the second pair of opposing sides of the first housing portion of the box like device includes a pair of spaced guides and the latching means includes a latching lug formed between the guides and a latch formed on the second side of the second pair of opposing sides of the second housing portion of the box like device, the latch operative for engaging the latching lug for securing together the first and second portions whereby the guides form a guide to the latch during opening and closing.

6. A seat belt buckle guard according to claim 1 wherein the first and second housing portions of the box like device are rectangularly shaped and the strengthening means includes a rib means formed in said first and second housing portion, contoured to support a correspondingly contoured seat belt buckle in alignment with the buckle tongue for connecting the buckle tongue and for coacting with the buckle and the first and second housing portions for rigidifying the box like device when closed by the latching means.

7. A seat belt buckle guard for a seat belt buckle having an exposed release mechanism comprising:

in combination, a seat belt means including a segmented belt, a buckle and buckle tongue connected, respectively, to first and second ends of the segmented seat belt, and an exposed release mechanism connected to the buckle;

a flexible plastic box like means connected to the buckle for protecting the buckle's exposed release mechanism against unintentional actuation, said box like means having first and second portions, each portion including first and second pairs of opposing sides, the first pair of opposing sides of the first and second portions being shaped to form apertures for a portion of the seat belt adjacent to the buckle and for passing the tongue portion into the box like means for attachment to the buckle, the second pair of opposing sides each having first and second sides aligned to abut the first and second portions;

a hinge means connecting the first sides of the second pairs of opposing sides together for forming a pivotal top;

a seat belt buckle positioning means including an inwardly extending recess formed in a first one of the second sides of second pairs of opposing sides for coacting with the buckle for positioning the buckle within the box like means and providing rigidity to the first and second portions thereof; and a latching means connected exteriorly of the second sides of the second pair of opposing sides for latching the first and second portions of the box like means together when closed, said latching means including a latching lug means mounted in the recess for receiving a latching means, and a latch means formed on the second one of the second pair of opposing sides, said latching lug means for retaining the latch within the recess for protection against unintentional opening of the box like means.

8. A seat belt buckle guard for a seat belt buckle having an exposed release mechanism comprising:

in combination, a flexible box like device having first and second portions, said first and second portions having walls forming opposing first and second apertures adapted for receiving end portions of a segmented seat belt attached, respectively, to a buckle and buckle tongue, a hinged side means for pivotally connecting the first and second portions together at a first side, and an opposing latching side means for joining the first and second portions; and rib means operatively connected to the first and second portions of the box like device normal to the first and second apertures and having contoured surfaces for forming a support for supporting a seat belt buckle in alignment with the first aperture whereby a seat belt buckle supported by the rib means is in alignment for connection to a seat belt buckle and for coacting with the seat belt buckle and with the first and second portions of the flexible box like device for forming a rigid seat belt buckle release guard which is difficult for a child to open and release the buckle.

9. A seat belt buckle guard for a segmented seat belt having a buckle carrying segment and corresponding buckle tongue carrying segment and a buckle with an exposed release mechanism comprising:

in combination, means for forming a box like device having first and second portions having opposing side means forming first and second apertures for providing passages, respectively, for a belt of a seat belt buckle carrying segment and tongue of a seat belt tongue carrying segment;

a seat belt buckle positioning means integrally formed within the box like device for receiving and positioning a belt buckle segment with respect to the second aperture of the opposing side means apertured side for receiving a belt buckle tongue, said positioning means formed integrally with at least one of the first and second portions;

a convex hinge means for integrally connecting the first and second portions of the box like device; and a latching means connected to sides of the first and second portions opposite the hinged sides of the first and second portions and adjacent to the buckle positioning means for securing the first and second portions of the box like device together, said latching means responsive to the seat belt buckle positioning means and belt buckle for enhancing the latching strength of the latching means.

* * * * *

UNITED STATES PATENT AND TRADEMARK OFFICE

CERTIFICATE OF CORRECTION

PATENT NO. : 4,731,912

DATED : March 22, 1988

INVENTOR(S) : Helen Ann Boriskie and Louis Emmer

It is certified that error appears in the above-identified patent and that said Letters Patent is hereby corrected as shown below:

Column 1, line 11, "of" should be --to--.

Column 1, line 15, "trapped" should be --strapped--.

Column 4, line 2, "sprng" should be --spring--.

Signed and Sealed this

Eleventh Day of October, 1988

*Attest:*

DONALD J. QUIGG

*Attesting Officer*

*Commissioner of Patents and Trademarks*